US008075455B2

(12) United States Patent
Gamboa et al.

(10) Patent No.: US 8,075,455 B2
(45) Date of Patent: Dec. 13, 2011

(54) JUMP ROPE HANDLE EXERCISE DEVICE

(75) Inventors: Ricardo Gamboa, Monterey Park, CA (US); Peter T. Garcia, Claremont, CA (US)

(73) Assignee: Borg Unlimited, Inc., Monterey Park, CA (US)

( * ) Notice: Subject to any disclaimer, the term of this patent is extended or adjusted under 35 U.S.C. 154(b) by 23 days.

(21) Appl. No.: 11/846,307

(22) Filed: Aug. 28, 2007

(65) Prior Publication Data

US 2009/0062084 A1 Mar. 5, 2009

(51) Int. Cl.
*A63B 5/20* (2006.01)
*A63B 15/00* (2006.01)

(52) U.S. Cl. ..... 482/82; 482/109

(58) Field of Classification Search ..... 482/20, 482/89, 117, 10–12, 44–50, 79, 81–82, 92–93, 482/109–110, 121–128, 148; *A63B 5/20, A63B 15/00*

See application file for complete search history.

(56) References Cited

U.S. PATENT DOCUMENTS

| | | | | | |
|---|---|---|---|---|---|
| 281,097 | A | * | 7/1883 | McGinnis | 607/77 |
| 310,733 | A | * | 1/1885 | Shaw | 607/77 |
| 593,056 | A | * | 11/1897 | Maingot | 482/108 |
| 768,581 | A | * | 8/1904 | Burks et al. | 607/77 |
| 1,462,088 | A | | 7/1923 | Sares | |
| 3,428,325 | A | * | 2/1969 | Atkinson | 473/256 |
| 3,731,384 | A | * | 5/1973 | Brooks et al. | 433/32 |
| 4,043,553 | A | * | 8/1977 | Suarez | 482/110 |
| 4,092,799 | A | * | 6/1978 | Anderson | 446/247 |
| 4,093,211 | A | * | 6/1978 | Hughes et al. | 482/49 |
| 4,293,125 | A | * | 10/1981 | Hinds | 482/82 |
| 4,489,937 | A | * | 12/1984 | Kong | 482/126 |
| 4,505,474 | A | * | 3/1985 | Mattox | 482/82 |
| 4,714,245 | A | * | 12/1987 | Cho | 482/82 |
| 4,784,391 | A | * | 11/1988 | Herron | 273/109 |
| 4,801,137 | A | * | 1/1989 | Douglass | 482/82 |
| 4,878,673 | A | * | 11/1989 | Pollard | 473/409 |
| 4,934,691 | A | * | 6/1990 | Rudd | 482/82 |
| 5,058,883 | A | * | 10/1991 | Dybvik | 482/82 |
| 5,092,583 | A | * | 3/1992 | Rudolf | 482/82 |
| 5,167,596 | A | * | 12/1992 | Ferber | 482/46 |
| 5,180,352 | A | * | 1/1993 | Sreter | 482/108 |
| 5,221,088 | A | * | 6/1993 | McTeigue et al. | 473/201 |
| 5,224,910 | A | * | 7/1993 | Deutsch | 482/82 |
| 5,242,349 | A | * | 9/1993 | Reiff et al. | 482/106 |
| 5,342,271 | A | * | 8/1994 | Long | 482/98 |
| 5,393,285 | A | * | 2/1995 | Fischer et al. | 482/108 |
| 5,406,300 | A | * | 4/1995 | Tokimoto et al. | 345/31 |

(Continued)

*Primary Examiner* — Loan Thanh
*Assistant Examiner* — Oren Ginsberg
(74) *Attorney, Agent, or Firm* — Kelly Lowry & Kelley, LLP

(57) ABSTRACT

A rope-less jump rope exercise device includes a handle and a flexible, elongated lash having a first end associated with the handle and a second end. A ball-and-socket assembly interconnects the first end of the lash and the handle in order to provide rotary movement of the lash relative to the handle in all directions. The handle, lash and ball-and-socket assembly form one half of a pair of identical jump rope exercise assemblies which jointly comprise the jump rope exercise device. Alternatively, a rope-less jump rope exercise device includes a handle defining an inner cavity and a flexible, elongated lash having a first end at partially disposed within the inner cavity and a second end. A spring disposed within the inner cavity is configured to interconnect the handle and the lash and resist movement of the lash out of the inner cavity.

13 Claims, 2 Drawing Sheets

U.S. PATENT DOCUMENTS 5,445,581 A * 8/1995 Ferber ..... 482/46
5,474,293 A * 12/1995 Tanaka ..... 473/570
5,484,361 A * 1/1996 Dunn ..... 482/51
5,490,817 A * 2/1996 Stander et al. ..... 482/46
5,542,672 A * 8/1996 Meredith ..... 463/37
5,620,397 A * 4/1997 Chieh ..... 482/46
5,697,871 A * 12/1997 Landfair ..... 482/82
5,730,655 A * 3/1998 Meredith ..... 463/37
5,842,956 A * 12/1998 Strachan ..... 482/82
5,895,341 A * 4/1999 Jones ..... 482/81
5,984,796 A * 11/1999 Mah ..... 473/215
D418,557 S * 1/2000 Cousins ..... D21/672
6,264,519 B1 * 7/2001 Brown ..... 441/55
6,265,984 B1 * 7/2001 Molinaroli ..... 340/815.4
6,269,821 B1 * 8/2001 Berke et al. ..... 132/317
6,286,396 B1 * 9/2001 Johnson ..... 81/60
6,439,241 B2 * 8/2002 Berke et al. ..... 132/200
6,522,255 B1 * 2/2003 Hsieh ..... 340/657
6,540,649 B1 * 4/2003 Niedrich ..... 482/82
6,551,222 B1 * 4/2003 Beaver ..... 482/82
6,595,827 B2 * 7/2003 Kirley ..... 446/219
6,659,920 B1 * 12/2003 Kurz ..... 482/121
6,692,416 B1 * 2/2004 Davis ..... 482/139
6,752,746 B1 * 6/2004 Winkler et al. ..... 482/82
6,776,679 B1 * 8/2004 Menow ..... 446/236
6,778,866 B1 * 8/2004 Bettwy ..... 700/56
6,887,188 B1 * 5/2005 Davies ..... 482/82
6,932,747 B2 * 8/2005 Herman ..... 482/126
6,969,257 B2 * 11/2005 Groen ..... 434/252
7,147,580 B2 * 12/2006 Nutter et al. ..... 473/457
7,172,534 B1 * 2/2007 Joy et al. ..... 482/82
7,232,238 B2 * 6/2007 Long et al. ..... 362/192
7,329,212 B2 * 2/2008 Roque ..... 482/110
7,337,933 B1 * 3/2008 Klinberg et al. ..... 223/118
D566,206 S * 4/2008 Yang ..... D21/672
7,354,383 B2 * 4/2008 Bardha ..... 482/82
7,361,074 B1 * 4/2008 Periman et al. ..... 446/242
7,404,651 B2 * 7/2008 Long et al. ..... 362/192
7,462,140 B1 * 12/2008 Lombardozzi ..... 482/82
7,611,449 B2 * 11/2009 Kim ..... 482/110
2003/0087734 A1 * 5/2003 Kring et al. ..... 482/112
2004/0002408 A1 * 1/2004 Rigas ..... 482/82
2005/0288158 A1 12/2005 LaTour
2007/0201223 A1 * 8/2007 Long et al. ..... 362/157
2007/0281838 A1 * 12/2007 O'Shea et al. ..... 482/82
2009/0036279 A1 * 2/2009 Kim ..... 482/109

* cited by examiner

JUMP ROPE HANDLE EXERCISE DEVICE

BACKGROUND OF THE INVENTION

The present invention relates to exercise devices. More particularly, the present invention relates to a rope-less jump rope handle exercise device, where the handles are not connected by a rope or other similar means.

Generations of young people have enjoyed playing jump rope and many athletes, such as boxers, has used jump ropes for aerobic exercise and physical conditioning. Conventional jump ropes are typically constructed of a pair of handles interconnected by a rope, as seen in U.S. Pat. No. 1,462,088. The handles of these conventional jump ropes have been constructed of solid wood, plastic or the like with the rope mechanically connected thereto.

However, conventional jump ropes such as those described above, have certain disadvantages. For example, the use of the conventional jump rope is limited by the fact that a user must actually jump over the rope. This is not possible for a user who is not able to jump (e.g., a person in a wheel chair, has a bad back, knees or the like) but who still wishes to obtain the benefits derived from jumping rope. The use of a conventional jump rope can result in a user tripping over the rope and falling to the ground and can cause a great deal of noise as it is being used. A conventional jump rope also requires a great deal of open space and a relatively high ceiling as the rope must be able to clear the user's head without contacting a ceiling surface.

Various attempts have been made to overcome the problems associated with conventional jump rope devices. For example, U.S. Pat. No. 6,752,746 discloses an adjustable jump rope apparatus with an adjustable weight and length. However, this jump rope still suffers from the same drawbacks as the conventional jump rope as there is still only a single rope interconnecting the two handles and thus requiring a user to have to jump over the rope in order to use the device. In another example, U.S. Patent Application No. 2004/0002408 discloses a pair of virtual jump rope units. However, the ball bearing assembly inside the handle to which the rope is attached provides only limited movement. In a further example, U.S. Patent Application No. 2005/0288158 discloses a ropeless jump rope. However, this device requires the use of electronics, a power supply, a display and the like.

Accordingly, there is a need for a jump rope device which mimics the benefits of a conventional jump rope without the drawbacks associated with the conventional jump rope. There is a further need for a jump rope device that eliminates the need for a user to jump in order to use the device. There is an additional need for a jump rope device that is simple and economical to manufacture. The present invention fulfills these needs and provides other related advantages.

SUMMARY OF THE INVENTION

The present invention resides in an apparatus that provides a rope-less jump rope handle exercise device. As illustrated herein, an embodiment of a jump rope exercise device includes a handle and a flexible, elongated lash having a first end associated with the handle and a second end. A ball-and-socket assembly interconnects the first end of the lash and the handle in order to provide rotary movement of the lash relative to the handle in all directions. The handle, lash and ball-and-socket assembly form one half of a pair of identical jump rope exercise assemblies which jointly comprise the jump rope exercise device.

The jump rope exercise device also includes a mechanism for providing wind resistance and softening the impact of accidental strikes of the second end of the lash. The wind resistance providing and impact softening mechanism comes in various forms including, but not limited to, a protective pad. The protective pad comes in various forms including, but not limited to, a foam ball, a gel-filled inner portion and a foam outer portion, or the like.

The handle of the jump rope exercise device includes a grip which can be in the form of a cover disposed over the handle.

The lash of the jump rope exercise device comes in various forms including, but not limited to a hollow tube, an extruded material or the like.

The ball and socket assembly comprises a cap connected to one of the handle and the lash, wherein a ball connected to the other of the handle and the lash is received within a socket defined by the cap.

In another embodiment, a jump rope exercise device includes a handle defining an inner cavity and a flexible, elongated lash having a first end at least partially disposed within the inner cavity and a second end. A spring disposed within the inner cavity is configured to interconnect the handle and the lash and resist movement of the lash out of the inner cavity. The handle, lash and spring form one half of a pair of identical jump rope exercise assemblies which jointly comprise the jump rope exercise device. This embodiment of the jump rope exercise device is otherwise similar, if not the same, as the one described above.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2:
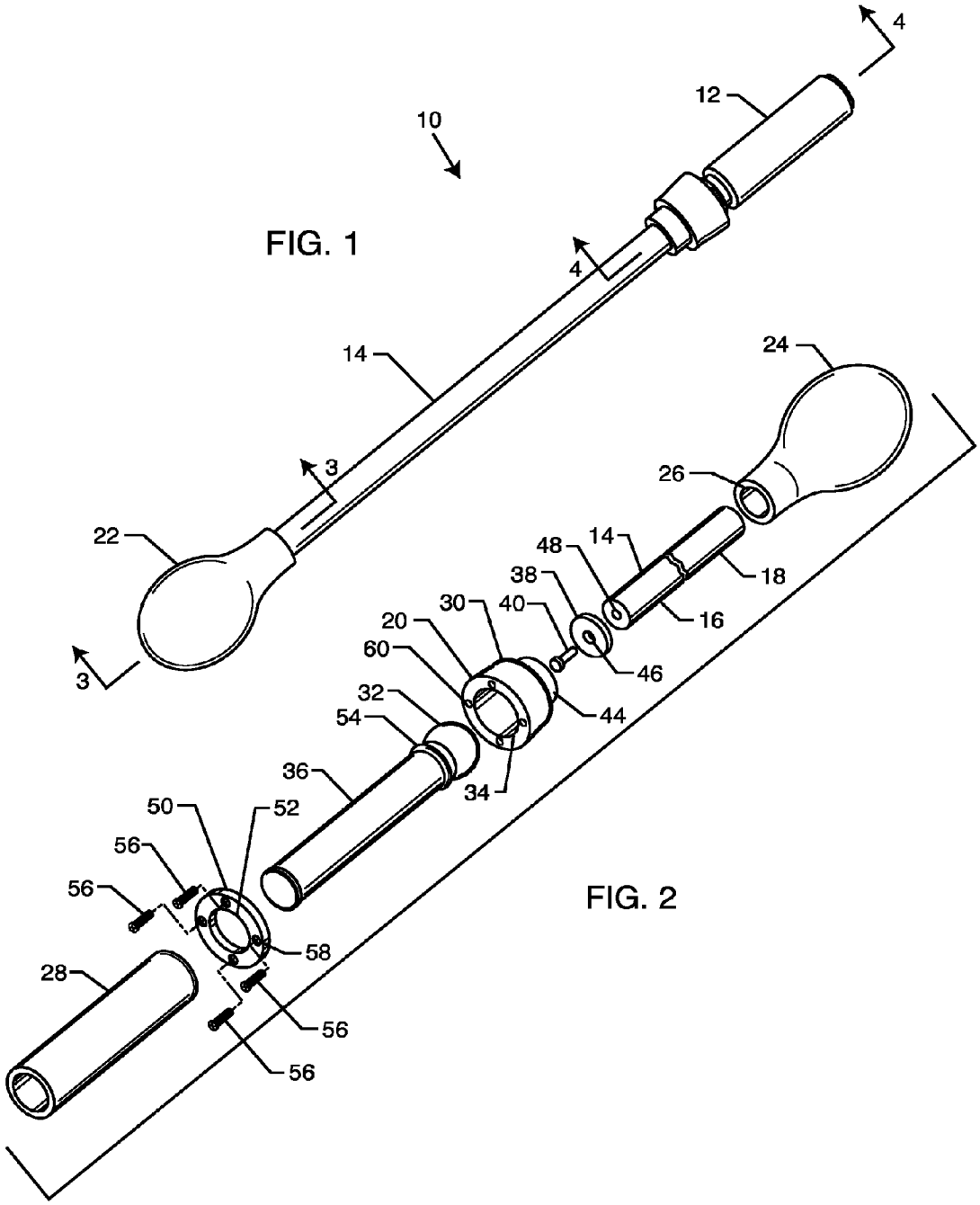
FIG. 1 is a perspective view of a jump rope handle exercise device embodying the present invention.
FIG. 2 is an exploded perspective view of the device of FIG. 1.
Figure 3:
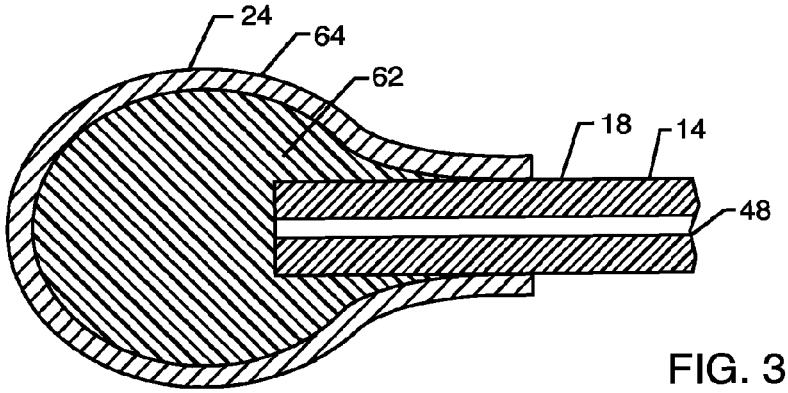
FIG. 3 is a cross-sectional view taken generally along the line 3-3 of FIG. 1.

As shown in FIGS. 1-5 for purposes of illustration, the present invention is concerned with a rope-less jump rope handle exercise device 10, where handles are not connected by a rope or other similar means.

As illustrated herein, an embodiment of a jump rope exercise device 10 includes a handle 12 and a flexible, resilient, elongated lash 14 having first and second ends 16, 18.

A ball-and-socket assembly 20 interconnects the first end 16 of the lash 14 and the handle 12 in order to provide rotary movement of the lash 14 relative to the handle 12 in all directions. The handle 12, lash 14 and ball-and-socket assembly 20 form one half of a pair of identical jump rope exercise assemblies which jointly comprise the jump rope exercise device 10.

The jump rope exercise device also includes a mechanism 22 for providing wind resistance and softening the impact of accidental strikes of the second end 18 of the lash 14 against a user, a surface or an object. The wind resistance providing and impact softening mechanism 22 comes in various forms including, but not limited to, a protective pad 24. The protective pad 24 includes a hollow bore 26 for into which the second end 18 of the lash 14 may be inserted.

The handle 12 of the jump rope exercise device 10 includes a grip 28 which can be in the form of a cover disposed over the handle 12 in order to resist slippage. The grip 28 may be made of various materials including, but not limited to, foam, plastic, polyurethane or the like.

The lash 14 of the jump rope exercise device 10 comes in various forms including, but not limited to a flexible, resilient hollow tube, a solid extruded material, a solid molded material, a line, a rod, a rope, a cord, a strip, a chain, a braid or the like. The lash 14 made be made of various materials including, but not limited to a natural material, a synthetic material (e.g., PVC, plastic or the like), and combinations thereof. The length and thickness of the lash 14 may vary but the lash 14 is preferably about fifteen inches long. The device also serves as a free weight and can come in various weights including, but not limited to, a half pound, one pound, two pounds, two and a half pounds or the like.

Figure 4:
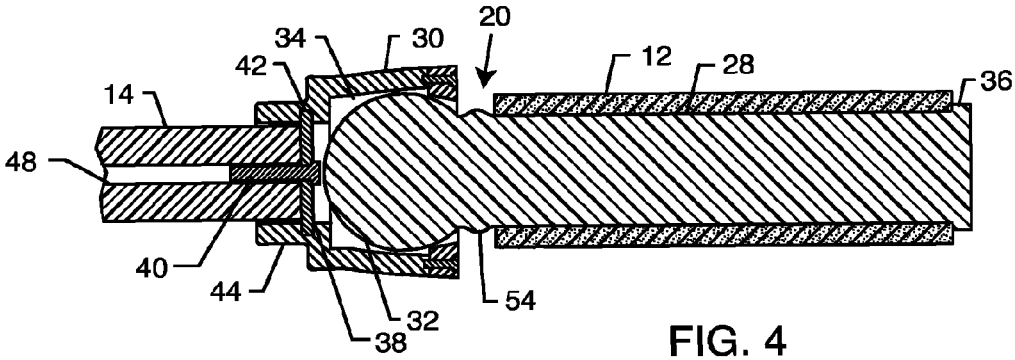
FIG. 4 is a cross-sectional view taken generally along the line 4-4 of FIG. 1.

The ball and socket assembly 20 includes a cap 30 connected to one of the handle 12 and the lash 14 with a ball 32 connected to the other of the handle 12 and the lash 14 is received within a socket 34 defined by the cap 30. The cap 30 may be made of various materials including, but not limited to plastic or the like. FIG. 4 illustrates the ball 32 as connected to the handle 12 where the handle 12 includes a main shaft 36 with the ball 32 being of single piece construction with the handle 12 and located at an end of the handle 12. In the alternative, the ball 32 can be mechanically connected to the handle 12 using various conventional methods.

The lash 14 is attached to the cap 30 using a washer 38 (made of MYLAR, metal or the like) and a fastener 40 (e.g., a screw, a bolt or the like). The washer 38 engages an annular slot 42 within the cap 30. The first end 16 of the lash 14 is inserted into a hollow neck 44 of the cap 30 until the first end 16 contacts the washer 38. The fastener 40 is then inserted through a central aperture 46 of the washer 38 and into a bore 48 opening onto the first end 16 of the lash 14, engaging the lash 14. This engagement prevents the lash 14 from flying off during use of the device 10 due to centrifugal force. A locking ring 50 having a central aperture 52 is then inserted behind the ball 32 onto a neck 54 of the handle 12 between the main shaft 36 and the ball 32. The central aperture 52 of the locking ring 50 has a diameter that is slightly smaller than the diameter of the ball 32. The ball 32 is then inserted into the socket 34 of the cap 30 and the locking ring 50 secured to the cap 30, containing the ball 32 within the socket 34 but providing sufficient room for the ball 32 to move within the socket 34 in a manner permitting rotary movement in all directions, thus translating that movement to the lash 14. Several fasteners 56 (e.g., screws or the like) are then inserted into respective bores 58 disposed about the central aperture 52 of the locking ring 50 and extending therethrough. The fasteners 56 are inserted into bores 60 disposed about the opening to the socket 34 of the cap 30 in order to secure the locking ring 50 to the cap 30 and securely contain the ball 32 within the socket 34. The grip 28 is then disposed over the main shaft 36 of the handle.

The protective pad 24 may come in various forms including, but not limited to, a compressible foam pad, a pad having a relatively dense gel material-filled inner portion 62 and a compressible foam material outer portion 64, or the like. The pad 24 may come in various shapes including, but not limited to a ball, a cylinder, a tear or the like. The thickness of the protective pad 24 can vary from a minimal thickness of eighths of an inch to several inches (e.g. 2-4 inches). For example, the protective pad 24 can in the form of a ball having a roughly three inch diameter. In the alternative, the pad 24 may be removably or permanently attached to the second end 18 of the lash 14 without being disposed about the second end 18 of the lash 14. Both removably and permanently attachable pads 24 can come in various shapes and sizes.

Figure 5:
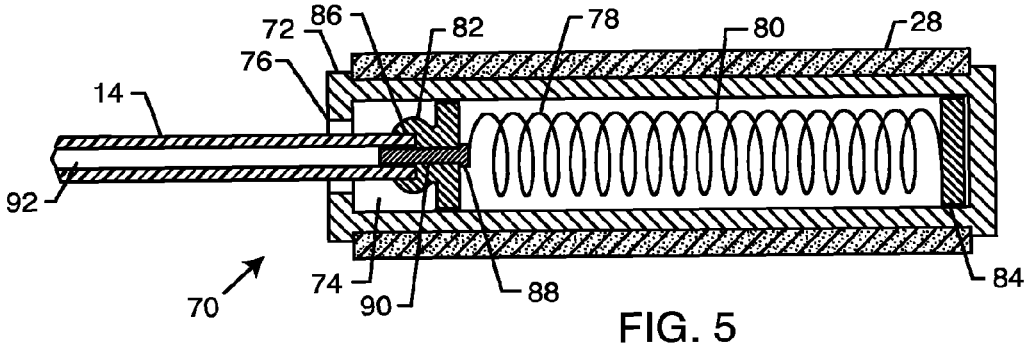
FIG. 5 is a cross-sectional view of another jump rope handle exercise device embodying the present invention.

In another embodiment, as seen in FIG. 5, a jump rope exercise device 70, similar/same to the device 10 described above, includes an alternative handle 72 defining an inner cavity 74 and a flexible, resilient elongated lash 14 having first and second ends 16, 18. The first end 16 of the lash 14 extends through a handle aperture 76 into the inner cavity 74, being at least partially disposed therewithin, and is connected to a spring mechanism 78 configured to interconnect the handle 72 and the lash 14 and resist movement of the lash 14 out of the inner cavity 74. The handle 72, lash 14 and spring mechanism 76 form one half of a pair of identical jump rope exercise assemblies which jointly comprise the jump rope exercise device 70. In all other respects, the device 70 includes similar, if not the same, features as the device 10 described above, including the protective pad 24, grip 28 and the like.

The spring mechanism 78, disposed within the inner cavity 74, includes a spring 80 which interconnects first and second end pieces 82, 84. The spring mechanism 78 provides resistance to centrifugal force pulling the lash 14 away from the handle 72. The spring mechanism 78 is secured within the inner cavity 74 by the second end piece 84 which is connected to one end of the inner cavity 74, the spring 80 allowing the first end piece 82 to move relatively freely along the length of the inner cavity 74.

The first end 16 of the lash 14 is inserted into a recess 86 of the first end piece 82. A fastener 88 (e.g., a screw, a bolt or the like) is then inserted through a central bore 90 (threaded or non-threaded) of the first end piece 82 and into a threaded bore 92 opening onto the first end 16 of the lash 14, engaging the lash 14. This engagement prevents the lash 14 from flying off during use of the device 70 due to centrifugal force. The area of the first end piece 82 surrounding the recess 86 is generally spherical or ball-shaped in order to allow the first end piece 82 to move in a manner permitting rotary movement in all directions when the first end piece 82 contacts the end of the inner cavity 74 by the handle aperture 76, thus translating that movement to the lash 14.

All features of the various embodiments discussed above can be mixed and matched to define an embodiment that is not directly illustrated in the accompanying figures.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A rope-less jump rope exercise device, comprising:

a handle;

a continuously flexible, elongated lash having a first end associated with the handle and a second end, wherein the lash comprises a hollow tube; and a single ball-and-socket assembly interconnecting the first end of the lash and the handle and disposed along the handle, to provide a single location for multiaxial rotary movement of the entire lash relative to the handle in all three-dimensional directions, the ball-and-socket assembly comprising a cap connected to the first end of the lash and a ball fixedly connected to the handle where the ball is received within a socket defined by the cap, the ball being secured within the socket by a removable locking ring attached to the cap;

wherein the handle, lash and ball-and-socket assembly form one half of a pair of identical rope-less jump rope exercise assemblies which jointly comprise the rope-less jump rope exercise device.

2. The jump rope exercise device of claim 1, including a mechanism for providing wind resistance and softening the impact of accidental strikes of the second end of the lash.

3. The jump rope exercise device of claim 2, wherein the mechanism for providing wind resistance and softening the impact of accidental strikes of the second end of the lash comprises a protective pad.

4. The jump rope exercise device of claim 3, wherein the protective pad comprises a foam ball.

5. The jump rope exercise device of claim 3, wherein the protective pad comprises a gel-filled inner portion and a foam outer portion.

6. The jump rope exercise device of claim 1, wherein the handle includes a grip comprising a cover disposed over the handle.

7. The jump rope exercise device of claim 1, wherein the lash comprises an extruded material.

8. A rope-less jump rope exercise device, comprising:

a handle;

a continuously flexible, elongated lash having a first end associated with the handle and a second end, wherein the lash comprises a hollow tube;

a single ball-and-socket assembly interconnecting the first end of the lash and the handle and disposed along the handle, to provide a single location for multiaxial rotary movement of the entire lash relative to the handle in all three-dimensional directions, the ball-and-socket assembly comprising a cap connected to the first end of the lash, and a ball fixedly connected to the handle, where the ball is received within a socket defined by the cap, the ball being secured within the socket by a removable locking ring attached to the cap; and a mechanism for providing wind resistance and softening the impact of accidental strikes of the second end of the lash;

wherein the handle, lash and ball-and-socket assembly form one half of a pair of identical rope-less jump rope exercise assemblies which jointly comprise the rope-less jump rope exercise device.

9. The jump rope exercise device of claim 8, wherein the mechanism for providing wind resistance and softening the impact of accidental strikes of the second end of the lash comprises a protective pad.

10. The jump rope exercise device of claim 9, wherein the protective pad comprises a foam ball.

11. The jump rope exercise device of claim 9, wherein the protective pad comprises a gel-filled inner portion and a foam outer portion.

12. The jump rope exercise device of claim 8, wherein the handle includes a grip comprising a cover disposed over the handle.

13. The jump rope exercise device of claim 8, wherein the lash comprises an extruded material.

* * * * *